US007418105B2

(12) United States Patent
McIntosh

(10) Patent No.: US 7,418,105 B2
(45) Date of Patent: Aug. 26, 2008

(54) SHEATH FOR IN-EAR DEVICE

(75) Inventor: Ian McIntosh, Alexandria (CA)

(73) Assignee: Sonomax Hearing Healthcare Inc., Montréal (CA)

( * ) Notice: Subject to any disclaimer, the term of this patent is extended or adjusted under 35 U.S.C. 154(b) by 463 days.

(21) Appl. No.: 11/002,314

(22) Filed: Dec. 3, 2004

(65) Prior Publication Data

US 2005/0123160 A1 Jun. 9, 2005

Related U.S. Application Data

(60) Provisional application No. 60/526,967, filed on Dec. 5, 2003.

(51) Int. Cl.
*H04R 25/00* (2006.01)

(52) U.S. Cl. ..... 381/322; 381/325; 381/328

(58) Field of Classification Search ..... 381/322, 381/323, 324, 325, 327, 328, 330; 206/5; 181/128, 129, 130, 132, 135
See application file for complete search history.

(56) References Cited

U.S. PATENT DOCUMENTS 5,006,055 A * 4/1991 Lebisch et al. ..... 425/2
6,339,648 B1 1/2002 McIntosh et al.
6,754,357 B2 * 6/2004 McIntosh et al. ..... 381/322

* cited by examiner

*Primary Examiner*—Brian Ensey
(74) *Attorney, Agent, or Firm*—Ogilvy Renault LLP

(57) ABSTRACT

A sheath may be folded inside-out to cover a core-form and form an in-ear device therewith. A settable compound is injected between the spacing formed between core-from and sheath to allow in-situ fitting. The sheath is of variable thickness, having lower thickness portions and augmented thickness portions to direct flow and settling of settable compound during in-situ fitting.

17 Claims, 4 Drawing Sheets

SHEATH FOR IN-EAR DEVICE

CROSS-REFERENCE TO RELATED APPLICATION

This application claims the benefit of priority of U.S. Provisional Application Ser. No. 60/526,967, filed on Dec. 5, 2003. The disclosure of the above application is incorporated herein by reference in its entirety.

FIELD OF THE INVENTION

The present invention generally relates to sheaths for covering in-ear devices such as earplugs, hearing aid devices and the like, and more particularly to sheaths that may expand to match the contour of the ear in which an in-ear device is engaged.

BACKGROUND OF THE INVENTION

The term in-ear device (IED) includes active devices, either of a hearing protection nature, or of a hearing aid nature, in which some or all of the batteries and other components are mounted behind the ear, or remotely, in a box that communicates with the IED unit by means of a sound-tube, or by wires. As such, IEDs include powered, active devices in which a microphone, speaker, and all the associated sound-processing circuitry and components, including a battery, are contained within the in-ear unit. IEDs may also be passive, i.e. not powered, and some simply amount to a plug in the ear. More sophisticated passive IEDs may include acoustic chambers and filters, for passing or attenuating selected frequencies.

Regardless of the active or passive nature of IEDs, it is recognized that the performance of all IEDs is highly dependent upon the fit of the IED in the ear. If the IED is a poor fit, excess or undesired sound may simply by-pass the IED, causing the wearer to hear undesired sounds. The tendency therefore is for the IED to be too tight, which leads to poor wearer-comfort, whereby the wearer tends not to keep the IED in for long periods.

Recent trends in hearing aid IEDs seek to overcome the traditional problems with fit by providing multi-channel sound transmission or by eliminating feedback. Such techniques may be useful for improving quality of sound and reducing feedback. However, since the shapes of the ears of different wearers are not the same, the efficacy of such techniques may not necessarily be consistent from one wearer to another. Further, such techniques may require frequent readjustment of the IED in different hearing environments. Accordingly, it is advantageous to custom fit an IED to the ear of the wearer, on an in-situ basis, to minimize such difficulties.

A variety of techniques and means may be used for custom fitting an IED to ear of the wearer. Such techniques and means include manufacturing the IED directly within the ear of the wearer, use of a deformable stretchable sheath to cover the IED and match the contour of the wearer's ear, or use of molds. These techniques and means are well known in the art.

U.S. Pat. No. 5,006,055 issued to Lebisch et al. on Aug. 4, 1989 discloses an apparatus for manufacturing an IED directly in the ear of a hearing-impaired person with a deformable envelope or sheath being pulled over a die or over a shell or over an overlayed over-shell. However, this rather long and tedious process requires many steps of assembly.

U.S. Pat. No. 5,333,622 and No. 5,131,411 issued to Casali et al. on Aug. 2, 1994 and on Jul. 21, 1992 respectively disclose a custom-molded IED, i.e. an ear plug, that can be used for selecting pre-sized earplugs or as a cast for creating a mold for earplugs or hearing aids. This earplug is not appropriate for custom fitting in-situ of an ear canal of an individual.

Canadian patent application No. 2,302,962/A1 of McIntosh et al. filed on Mar. 23, 2000 and laid open on Sep. 26, 2000 discloses a hearing apparatus adapted to be inflated in-situ using an inflation-medium. The apparatus includes a core portion that is generally covered by a separate sheath. The proper installation of the sheath requires extensive delicate care, especially when bonding the far end of the sheath to the core using the far-seal-means without obstructing the acoustic tube.

In light of the foregoing, it would be advantageous to have an IED that allows for facilitated in-situ fitting. Accordingly, it would be useful to have a means, such as a stretchable sheath, that may be easily employed with an IED to allow simple in-situ custom fitting of the IED in the wearer.

SUMMARY OF THE INVENTION

The present invention provides a stretchable sheath for at least partially covering a core-form of an in-ear device to define a spacing between the sheath and the core-form. A malleable settable compound may be introduced and held in the spacing to match a contour of at least one of a cavum concha and an ear canal of an ear with the in-ear device at least partially inserted therein to provide an optimized in-situ adjustment and fit of the in-ear device. The sheath has at least one lower thickness portion of a first thickness and at least one augmented thickness portion of a augmented thickness relative to the first thickness. The augmented thickness portion is located in an area in which less settable compound is desired for the optimized fit, whereby the augmented thickness impedes flow and settling of settable compound in the spacing adjacent to the augmented thickness portion compared to the spacing adjacent the lower thickness portion. In this fashion, inflation and stretching of the sheath is minimized in the augmented thickness portion while being maximized in the lower thickness portion to promote stretching thereof to match the contour of at least one of the cavum concha or ear canal of the user for an optimized in-situ fit.

BRIEF DESCRIPTION OF THE DRAWINGS

For a better understanding of the present invention, reference will now be made, by way of example, to the accompanying drawings, which aid in understanding an embodiment of the present invention. In the accompanying drawings, like characters indicate like features throughout.

DETAILED DESCRIPTION OF THE INVENTION

Figure 1:
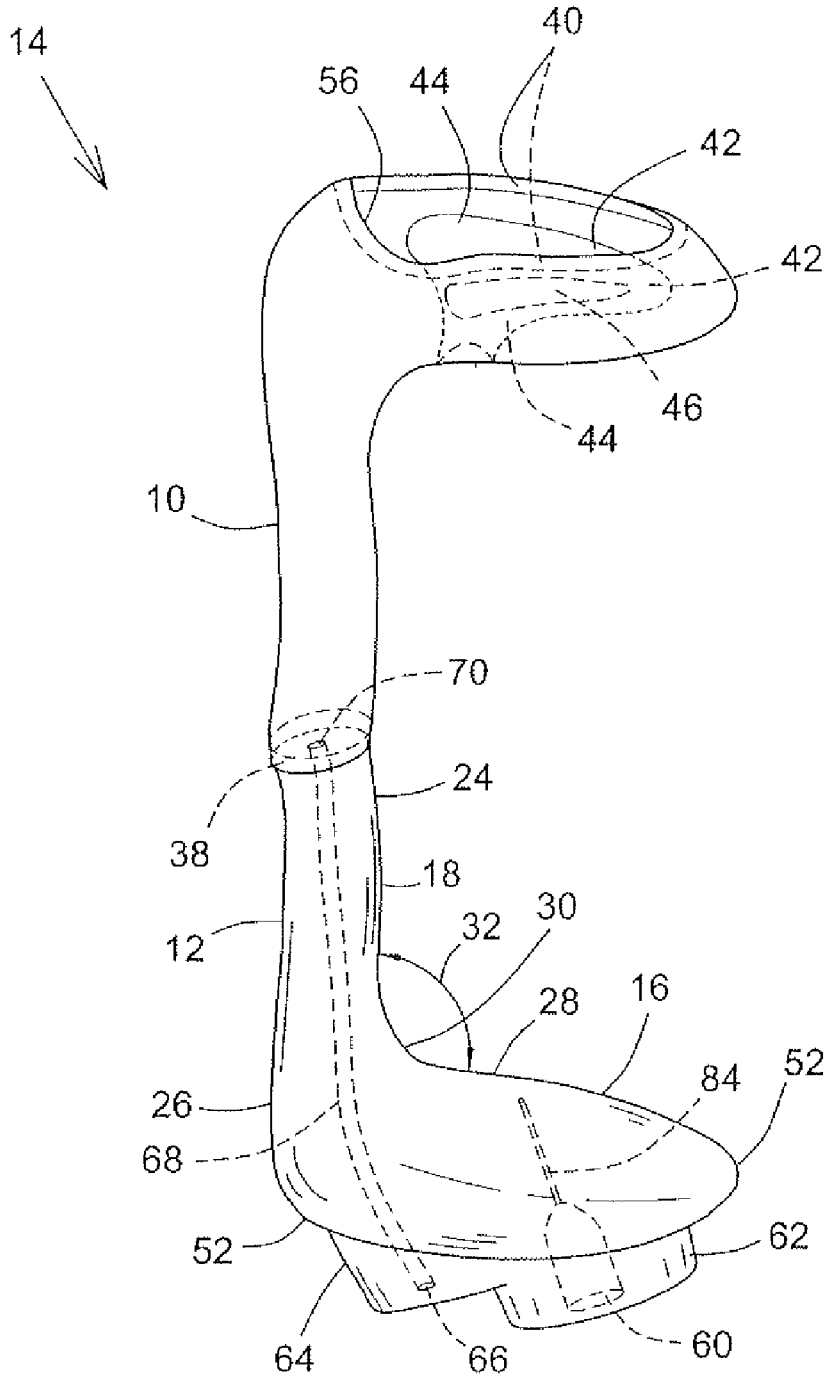
FIG. 1 is a side view of a sheath in accordance with an embodiment of the invention showing the sheath integrally extending from a core-form of an IED.
Figure 2:
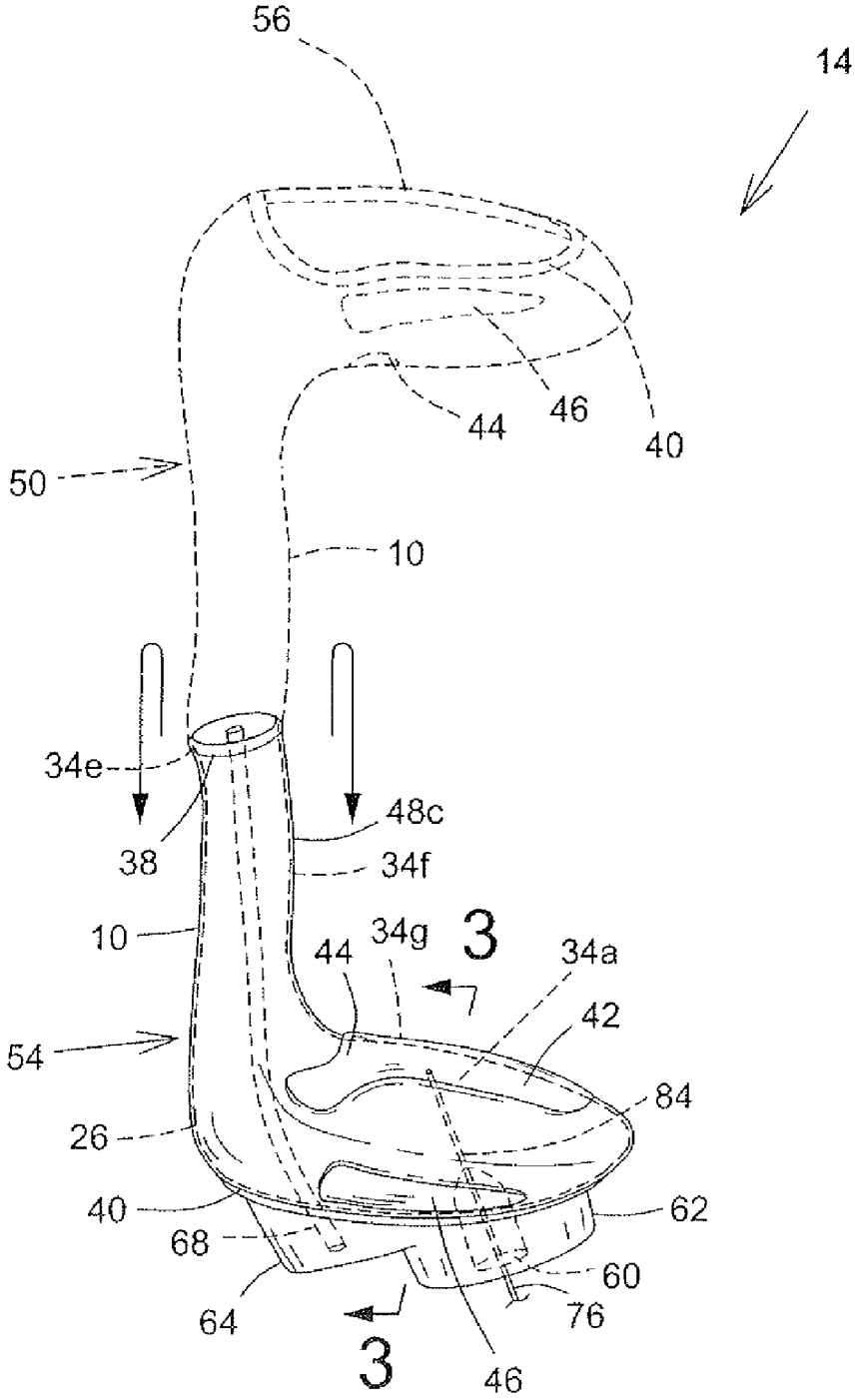
FIG. 2 is a side view of the embodiment of FIG. 1, showing the sheath integrally extended from the core-form and further showing the sheath folded inside-out to partially cover the core-form.

Referring now to FIGS. 1 to 6, therein is shown a sheath 10 accordance with an embodiment of the present invention. As shown in FIGS. 1 and 2, sheath 10 is sized and shaped to be a replication of the size and shape of core-form 12. When sheath 10 is connected or engaged upon core-form 12, sheath 10 and core-form 12 together form in-ear device (IED), shown generally as 14. Accordingly, shape of sheath 10 is determined by shape of core-form 12.

Figure 5:
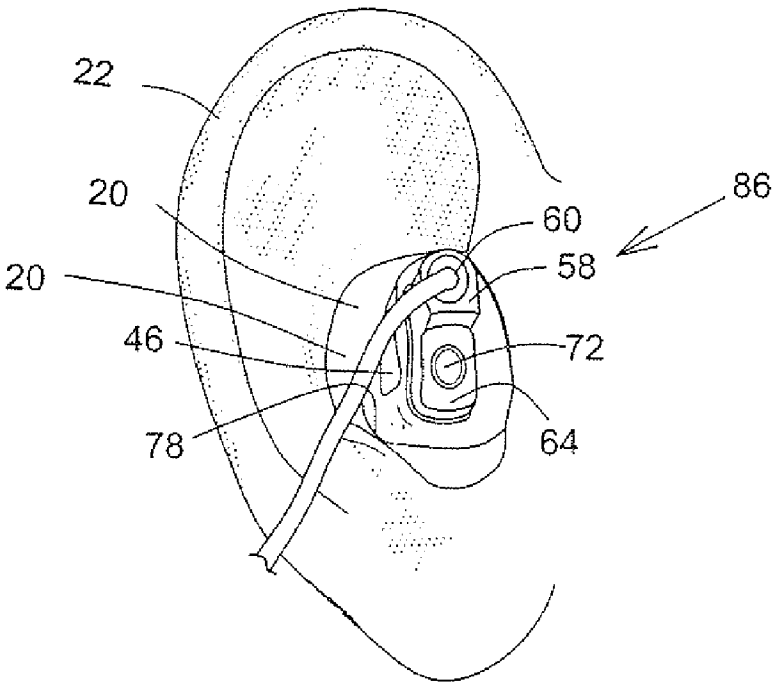
FIG. 5 is a top view of the embodiment of FIG. 1 showing the IED, with sheath, when initially inserted into an ear.

Referring now to FIG. 1 in conjunction with FIG. 5, core-form 12 has a substantially smooth surface and comprises platform section 16 and nipple section 18. Platform section 16 is pre-molded to reflect the shape and contour of the cavum concha 20 of an ear 22 of a wearer for engagement therein. Nipple section 18 is pre-molded, in a substantially tubular shape, to reflect the curved shape of the human ear canal, not shown, with a nipple proximal end 24 extendable therein. Nipple distal end 26 extends from platform proximal end 28 of platform section 16, and toward nipple proximal end 24, for engaging the ear canal of a wearer. Nipple distal end 26 and platform proximal end 28 form junction 30 having platform internal angle 32. Thus, nipple section 18 is integral to platform section 16 and extends therefrom.

Figure 4:
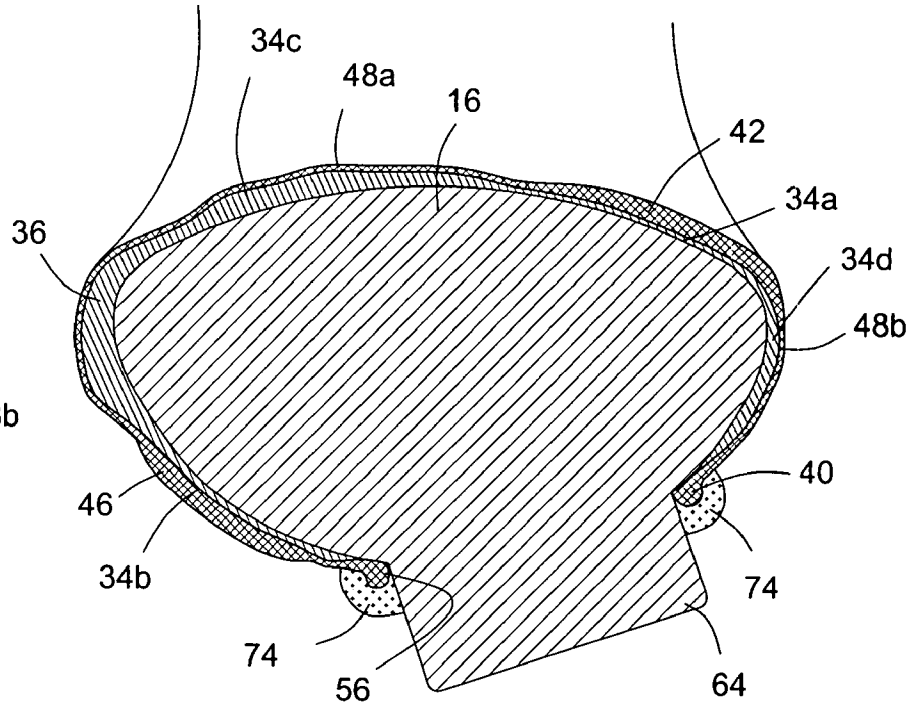
FIG. 4 is a partial enlarged sectional view taken along line 3-3 of FIG. 2, showing the sheath covering a platform section of the IED after injection of a settable compound
Figure 3:
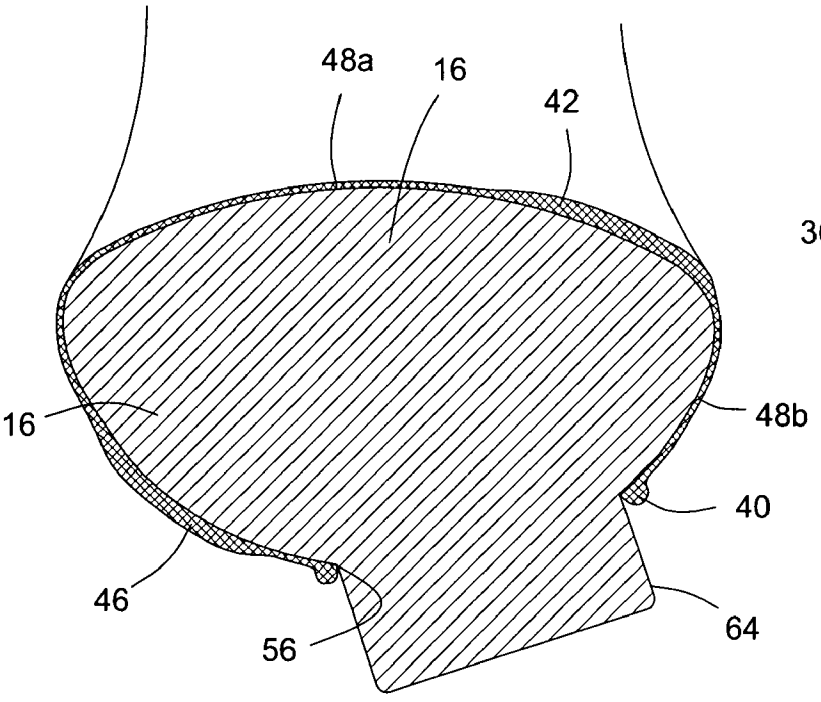
FIG. 3 is a partial enlarged sectional view taken along line 3-3 of FIG. 2, showing the sheath covering a platform section of the IED prior to injection of a settable compound.

Referring now to and FIGS. 2, 3, and 4, sheath 10 is adapted to be folded inside-out over core-form 12 and substantially assume the same shape thereof so as to at least partially cover core-form 12. Sheath 10 therefore defines an in-between region, or spacing 34, between sheath 10 and core-form 12 for allowing settable compound 36, as shown in FIG. 3, to be injected therethrough, and stretch or deform sheath 10 away from core-form 12 to generally assume and match the contour of at least one of ear canal or cavum concha 20 when IED 14 is at least partially inserted into ear 22. Thus, sheath 10 and core-form 12 together form IED 14 as a unitary device when sheath 10 is engaged upon core-form 12 and folded inside-out thereover. Spacing 34 and injection of settable compound 36 permit in-situ adjustment and fitting of IED 14 in ear 22.

Referring still to FIGS. 2, 3 and 4, sheath 10 is of variable thickness and has augmented thickness portion proximal collar 38, augmented thickness portion ridge 40, augmented thickness portion cavum concha pad 42, augmented thickness portion junction pad 44, and augmented thickness portion antitragus pad 46, of greater or augmented thickness compared to at least one lower thickness portion 48 of sheath 10, and which impede settling of settable material 36 and stretching of sheath 10 in spacing 34 adjacent thereto. Consequently, flow and settling of settable compound 36 may be advantageously directed during in-situ-fitting into spacing 34 adjacent lower thickness portion 48 of sheath 10 to allowing maximal stretching and flow of settable compound 36 thereunder to more closely match contour of ear 22 during in-situ fitting and adjustment.

Having described generally sheath 10 and core-form 12, a detailed description is now offered to better illustrate the process of in-situ adjustment and fitting of IED 14 and the effect of augmented thickness portions 38, 40, 42, 44, 46 to that process. The description will first focus on engaging sheath 10 upon core-form 12. The in-situ adjustment and fitting process will be discussed next. The role of lower thickness portion 48 and upper thickness portions 38, 40, 42, 44, 46 for in-situ adjustment and fitting will then be addressed.

Referring again to FIGS. 1 and 2, prior to in-situ adjustment and fitting of IED 14, sheath 10 must be engaged upon core-form 12 and folded inside-out to at least partially cover core-form 12 at platform section 16. Specifically, proximal collar 38 is initially and sealingly engaged upon nipple proximal end 24. At this point, sheath 10 extends integrally away, in unfolded configuration 50, from nipple proximal end 24. Sheath 10 is then folded inside-out over nipple section 18 towards nipple distal end 26, subsequently over platform proximal end 28, and then at least partially over platform distal end 52 into folded configuration 54. Thus, in folded configuration 54, sheath 10 substantially covers nipple section 18 and further covers at least a portion of platform distal end 52.

As shown in FIGS. 1, 3, and 4 sheath 10 has platform aperture 56 which overlays platform distal end 52 when sheath 10 is folded inside-out into folded configuration 54. Specifically, platform aperture 56, which is substantially defined by ridge 40 is shaped to assume the perimeter of delimited area 58 when sheath 10 is in folded configuration 54.

Figure 6:
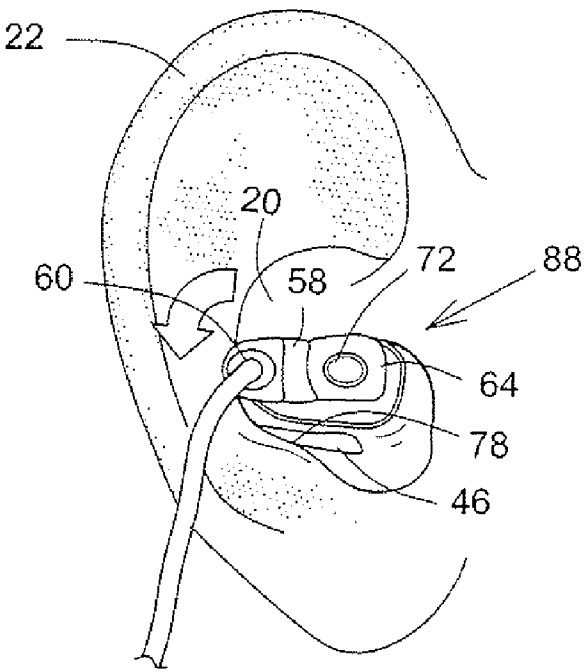
FIG. 6 is a top view of the embodiment of FIG. 1 showing the IED, with sheath, fully engaged in an ear by turning the platform section of IED towards the antitragus to be engaged within the cavum concha after the initial insertion shown in FIG. 5.

Delimited area 58 protrudes slightly outwardly from platform distal end 52. As shown in FIG. 1, delimited area 58 has injection aperture 60, housed in injection protrusion 62 extending outwardly from delimited area 58. Delimited area 58 also comprises platform sound bore protrusion 64 having platform sound bore aperture 66 for allowing sound to pass into sound bore 68 through nipple section 18 and into ear canal through nipple sound bore aperture 70 within proximal collar 38. Nipple sound bore aperture 70 may be made in sheath 10 during manufacture or created by a user or technician once sheath 10 is folded inside-out upon core-form 12. Platform sound bore aperture 66 may be covered by cap 72, as shown in FIGS. 5 and 6. Alternatively, platform sound bore aperture 66 may comprise a slit membrane or the like which closes whenever not engaged by a remote instrument such as a microphone of a measurement apparatus, not shown, or the like.

As shown in FIGS. 2 and 3, once sheath 10 is folded inside-out down into folded configuration 54, sheath 10 tightly assumes shape of core-form 12 such that spacing 34 is substantially fluidless, with no air entrapped therein. Further, as shown in FIG. 4, ridge 40, which defines platform aperture 56, may be sealingly engaged all around delimited area 58 with sealing agent 74, such as a glue or the like.

At this time, IED 14 is ready to be engaged in ear 22 and have settable compound 36 introduced into spacing 34. Specifically, to engage IED 14 in ear 22, IED 14 is initially inserted therein in an initial insertion position shown generally as 86 in FIG. 5, such that platform distal end 52 is substantially perpendicular to antitragus 78. Platform distal end 52 is subsequently turned counter-clockwise into engaged position 88, shown generally as 88 in FIG. 6, such that antitragus pad 46 of sheath 10 engages cavum concha 20 and lies therein, substantially parallel to antitragus 76. It should be noted that this method of engaging IED 14 in ear 22, by turning IED 14 from initial insertion position 86 to engaged position 88, is also used for engaging IED 14 in ear 22 after settable material 36 is set. Once IED 14 is fully engaged in ear 22, as shown in FIG. 6, settable compound 36 may be introduced into spacing 34 to effect in-situ adjustment and fitting.

Referring to FIG. 2 in conjunction with FIG. 4, settable compound 36 is introduced f or in-situ fitting and adjustment of IED 14 by injecting settable compound 36 into spacing 34 using injection device 76. Injection device 76 is received in injection aperture 60. Injection aperture 60 is located substantially opposite cavum concha pad 42 and provides communication with spacing 34*a* adjacent thereto via injection channel 84, which extends from injection aperture 60 to platform proximal end 28 adjacent spacing 34*a*. Thus, settable compound 36 may be injected into spacing 34 by inserting injection device 76 through injection aperture 60 and subsequently through injection channel 84 into spacing 34 adjacent platform proximal end 28 and injecting settable compound 36 therein. Alternatively, injection device 76 may be only partially inserted into injection channel 84 before injecting settable compound 36, settable compound 36 then traversing injection channel 84 and flowing subsequently into spacing 34. Injection aperture 60 is preferably self-closing upon retraction of injection device 76. However, injection aperture 60 may also be closed by an injection aperture cap, not shown, similar to cap 72 used to close platform sound bore aperture 66.

When settable compound 36 is injected into spacing 34, sheath 10 covering nipple section 18 is pushed away from core-form 12 to match shape and contour of ear canal 12. Similarly, spacing 34 adjacent to platform section 16 laying susbstantially parallel to antitragus 78 is also filled by settable compound 36 so as to assume the shape of cavum concha 20 of the wearer. Testing is then undertaken to ensure proper functioning of IED 14, including sound bore 68. IED 14 is then removed from ear 22 after settable compound 36 has set, thus completing in-situ adjustment and fitting.

As mentioned previously, proximal collar 38, ridge 40, cavum concha pad 42, junction pad 44, and antitragus pad 46 are augmented thickness portions of sheath 10 which optimize flow of settable compound 36 and stretching and inflation of sheath 10 during in-situ adjusting and fitting. Specifically, sheath 10 has at least one at lower thickness portion 48 of a first, lower thickness whereas augmented thickness portions proximal collar 38, ridge 40, cavum concha pad 42, junction pad 44, and antitragus pad 46 are of greater or augmented thickness compared to first, lower thickness of lower thickness portion 48.

The variations in sheath thickness are engineered to favour the flow of the compound 36 into specific areas of the nipple section 18 of the IED 14, as shown in FIG. 4 relative to FIG. 3, to achieve an acoustic seal, and in the platform section 16 in the cavum concha region to achieve stability and proper insertion and positioning of the IED 14 therein (see FIGS. 5 and 6 with the IED 14 in insertion 86 and engaged 88 positions, respectively), while maintaining the comfort of the IED 14 for the wearer, even after extended period of time. In FIG. 3, augmented thickness portions pad 42, 46 are shown having an augmented thickness compared to lower thickness of lower thickness portion 48, prior to injection of settable compound 36. As shown in FIG. 4, after insertion of settable compound 36, a greater quantity of settable compound 36 settles in spacing 34 adjacent lower thickness portions 48 compared to augmented thickness portions pads 42, 46. Thus, and more specifically, augmented thickness portions pads 42, 46 impede settling of settable compound 36 in spacing 34*a*, 34*b* respectively adjacent thereto during in-situ adjustment and fitting, resulting in a reduced quantity of settable compound 36 therein, compared to spacing 34*c*, 34*d* respectively adjacent lower thickness portions 48*a*, 48*b*.

Accordingly, inflation pressure and stretching of sheath 10 are optimized by facilitating and promoting flow and settling of settable material in spacing 34 adjacent lower thickness portion 48 to maximize stretching and adaptability thereof to shape of cavum concha 20 and ear canal.

Referring now to FIGS. 2, 5, and 6, augmented thickness portion antitragus pad 46 is locatable adjacent to core-form 12 and facing antitragus 78 when IED 14 is initially inserted into ear 22 in insertion position. When IED 14 is in engaged position 88, antitragus pad 46 is engaged within cavum concha 20 substantially parallel to antitragus 78. Flow and settling of settable compound 36 into spacing 34*b* adjacent antitragus pad 46 is therefore impeded. At the same time, antitragus pad 46 facilitates flow and settling of settable compound 36 into spacing 34*c* adjacent lower thickness portion 48*a* of sheath 10 overlaying platform proximal end 28 to facilitate stretching and expansion thereof to contour of cavum concha 22 to improve in-situ fit and adjustment. Further, when IED 14 is fully engaged in engaged position 88, antitragus pad 46 is bounded by antitragus 78 to enhance retention of IED 14 in ear 22. Antitragus pad 46 also renders IED 14 and sheath 10 side-specific for left ear and right ear as antitragus pad 46 must face antitragus 78 of ear 22 in which IED 14 is engaged.

Other augmented thickness portions proximal collar 38, ridge 40, junction pad 44, and antitragus pad 46, may also be shaped and sized to reinforce sheath 10 against rupture from internal stresses, such as, for example, stresses caused by introduction of an excess of settable compound 36 into spacing 34. Conversely, lower thickness portion 48 may be intentionally situated on a portion of sheath 10 that engages an external part of ear 22, such as cavum concha 20, as opposed to ear canal, to ensure that, in such a case excess settable compound 36, sheath 10 will first rupture within the external part of ear 22, thus protecting ear canal.

Further, augmented thickness portions, i.e. proximal collar 38, ridge 40, cavum concha pad 42, junction pad 44, and antitragus pad 46, may each have a different thickness compared to the others and the thickness of any one augmented thickness portion need not be uniform throughout. For example, antitragus pad 46 may be of varying thickness and may be thicker, in some parts, or less thick, in others than cavum concha pad 44. Lower thickness portions 48 may similarly vary in thickness.

In addition, while sheath 10 is described herein as being completely separate or detached from core-form 12 prior to engagement thereupon, it will be apparent to one skilled in the art that this need not necessarily be the case. For example, sheath 10 may also be attached to core-form 12 during manufacture to form a single molded member. It is not the intention of the inventors to limit sheath 10 and core-form 12 to a single molded member or separate pieces prior to injection of settable compound 36 and in-situ adjustment fitting of IED 14. It should further be noted that IED 14 may comprise a hearing protection device, hearing-aid device, or any other device for which an optimal in-situ fit or adjustment in ear 22 of wearer is desired or required. It is not the intention of the inventors to limit use of sheath 10 to a specific type of IED 14.

Core-form 12 is generally solid and rigid enough with substantial inherent structural rigidity while the stretchable sheath 10 is a thin stretchable material with substantially no inherent structural rigidity, both of them being made out of a silicone type of material or the like. The settable compound 36, while initially malleable, is preferably a rubber like type material once it is fully cured. It is not the intention of the inventors to limit restrict sheath 10 or core-form 12 to a specific material.

Although the present expandable in-ear device has been described with a certain degree of particularity it is to be understood that the disclosure has been made by way of example only and that the present invention is not limited to the features of the embodiment described and illustrated herein, but includes all variations and modifications within the scope and spirit of the invention as hereinafter claimed. It will be apparent to one skilled in the art that other embodiments of the present invention are possible.

The invention claimed is:

1. A stretchable sheath for at least partially covering a core-form of an in-ear device to define a spacing between said sheath and said core-form into which a malleable settable compound may be introduced and held to match a contour of at least one of a cavum concha and an ear canal of an ear with said in-ear device at least partially inserted therein to provide an optimized in-situ adjustment and fit of said in-ear device, a portion of said sheath forming an exposed surface of the in-ear device comprising:

at least one lower thickness portion of a first thickness; and at least one augmented thickness portion of an augmented thickness compared to said first thickness and located in an area in which less said settable compound is desired for said optimized fit, said augmented thickness impeding settling and flow of settable compound in said spacing adjacent said augmented thickness portion compared to said spacing adjacent said lower thickness portion.

2. The sheath of claim 1 wherein said sheath is permanently attached to said core-form.

3. The sheath of claim 1 wherein said sheath integrally extends from said core-form so as to be foldable inside-out for at least partially covering said core-form.

4. The sheath of claim 1, wherein said sheath is sized for covering a nipple section of said core-form engageable into said ear canal, said nipple section having a nipple proximal end extending into said ear canal and a nipple distal end extending toward said cavum concha when said in-ear device is engaged in said ear, wherein said sheath is for substantially covering said nipple section, from said nipple proximal end toward said nipple distal end, to define said spacing therewith.

5. The sheath of claim 4, wherein said sheath is sized for further covering at least a portion of a platform section of said core-form engageable into said cavum concha, said platform section comprising a platform proximal end and a generally opposed platform distal end, said platform proximal end forming a junction with said nipple distal end, said sheath being for substantially covering core-form, from said nipple section toward at least a portion of said platform section, to define said spacing therewith.

6. The sheath of claim 4, wherein said augmented thickness portion comprises a proximal collar locatable adjacent said nipple proximal end for sealingly engaging and covering said nipple proximal end, said collar substantially impeding said settable compound from flowing and extending said sheath beyond said nipple proximal end when said sheath covers said nipple section.

7. The sheath of claim 5, wherein said sheath further comprises a platform aperture for generally overlaying said platform distal end.

8. The sheath of claim 5, wherein said sheath further comprises a platform aperture for generally overlaying a delimited section of said platform distal end when said sheath is covers said platform section.

9. The sheath of claim 8, wherein said delimited section protrudes slightly away from said platform distal end.

10. The sheath of claim 5, wherein said augmented thickness portion comprises a junction pad locatable adjacent said junction, said junction pad substantially reducing entrapment of air in said spacing adjacent said junction, said junction pad further substantially impeding settling of settable compound in said spacing adjacent said junction pad and promoting flow of said settable compound towards said spacing in said nipple section so as to enable said nipple section to match at least a portion of said contour of said ear canal.

11. The sheath of claim 5, wherein said augmented thickness portion comprises an antitragus pad locatable on said platform section for engagement with an antitragus of said cavum concha, wherein said antitragus pad lays substantially parallel to said antitragus when said in-ear device is at least partially inserted, said antitragus pad substantially impeding settling of said settable compound into said spacing adjacent said antitragus pad so as reduce inflation thereof and facilitate engagement of said antitragus.

12. The sheath of claim 8 wherein said platform aperture is shaped to generally assume a perimeter of said delimited area.

13. The sheath of claim 8, wherein said augmented thickness portion comprises a ridge defining said platform aperture and shaped to generally assume a perimeter of said delimited area, said ridge facilitating positioning of said platform aperture on said delimited area and substantially impeding flow of said settable compound into said spacing adjacent said platform distal end to discourage passage of said settable compound through said platform aperture.

14. The sheath of claim 10, wherein said sheath is shaped to form a sheath angle to substantially match a platform internal angle formed at said junction by said platform proximal end and said nipple distal end.

15. The sheath of claim 1, wherein said lower thickness portion is locatable within said cavum concha when said device is at least partially inserted, said lower thickness portion easily rupturing compared to said augmented thickness portion and promoting drainage of said settable compound into said cavum concha to protect said ear canal when an excessive amount of said settable compound is introduced into said spacing.

16. The sheath of claim 15, wherein said augmented thickness section is locatable within said ear canal when said device is at least partially inserted, said augmented thickness portion rupturing less easily than said lower thickness portion to further promote drainage of settable compound into said cavum concha when an excessive amount of said settable compound is introduced into said spacing.

17. The sheath of claim 1, wherein said augmented lower thickness portion is locatable on a surface of said in-ear device facing generally away from said cavum concha and said ear canal when said in-ear device is at least partially inserted, said lower thickness portion easily rupturing and promoting drainage of said settable compound outside said cavum concha and said ear canal when an excessive amount of said settable compound is introduced into said spacing.

* * * * *